United States Patent [19]

Cronin

[11] Patent Number: 4,530,271

[45] Date of Patent: Jul. 23, 1985

[54] ELECTRIC ACTUATOR SYSTEM WITH HYDRAULIC COUPLING AS PROTECTION AGAINST MECHANICAL JAMMING

[75] Inventor: Michael J. Cronin, Sherman Oaks, Calif.

[73] Assignee: Lockheed Corporation, Burbank, Calif.

[21] Appl. No.: 496,710

[22] Filed: Jun. 21, 1983

[51] Int. Cl.[3] ..... F15B 11/00; F15B 13/00

[52] U.S. Cl. ..... 91/509; 91/437; 92/136

[58] Field of Search ..... 91/509, 437; 60/581, 60/594; 403/31, 24, 34; 92/136

[56] References Cited

U.S. PATENT DOCUMENTS

| | | | |
|---|---|---|---|
| 875,488 | 12/1907 | Bagnulo | 92/136 X |
| 2,315,110 | 3/1943 | Dornier | 318/430 X |
| 2,491,842 | 12/1949 | Wells | 318/103 X |
| 3,119,469 | 1/1964 | Farr et al. | 244/103 R X |
| 3,140,843 | 7/1964 | Pettit | 318/586 X |
| 3,263,572 | 8/1966 | Sunderland | 91/509 X |
| 3,411,410 | 11/1968 | Westbury et al. | 91/509 X |
| 3,741,073 | 6/1973 | Garnjost | 91/509 X |
| 3,771,918 | 11/1973 | Winter | 92/136 X |
| 3,790,108 | 2/1974 | Bock | 244/223 |
| 3,950,686 | 4/1976 | Randall | 318/564 |
| 4,427,348 | 1/1984 | Kofahl | 92/136 X |

FOREIGN PATENT DOCUMENTS

| | | | |
|---|---|---|---|
| 8104771 | 8/1982 | Netherlands | 92/136 |

*Primary Examiner*—Sheldon J. Richter
*Assistant Examiner*—Randolph A. Smith
*Attorney, Agent, or Firm*—Louis L. Dachs

[57] ABSTRACT

An actuator system for controlling the position of an aerodynamic control surface of an aircraft, such as an aileron, is disclosed. An actuator (12) having an output shaft (14) is mounted to a frame attached to the aircraft structure. A hydraulic coupling (32) is mounted on one side to the output shaft (14) of the actuator (12) and the other side to the control surface (50) and comprises a hydraulic cylinder (34) having a sealing member (36) movably mounted therein dividing the cylinder (34) into two portions (38, 40). The output shaft (14) of the actuator (12) is coupled to the cylinder (34) and an output shaft is attached to the sealing member (36) at one end and at its opposite end to the control surface or vice versa. A connecting tube (54) is provided coupling the two portions of the hydraulic cylinder together. The tube incorporates a valve (58) having a first position sealing off the two portions from each other and a second position providing a passageway therebetween. Thus, if the actuator (12) is working and the valve (56) is closed, an essentially solid connection is achieved between the actuator (12) and the control surface (50), thus allowing the actuator to move the control surface upon command. Should the actuator fail, the valve (56) can be opened, allowing fluid to flow from portion to portion. Thus, a redundant actuator can continue to control the position of the control surface while the disabled actuator is effectively decoupled from the control surface for the piston (36) will just move back and forth within the cylinder (34) as the control surface moves.

14 Claims, 11 Drawing Figures

Fig.8.
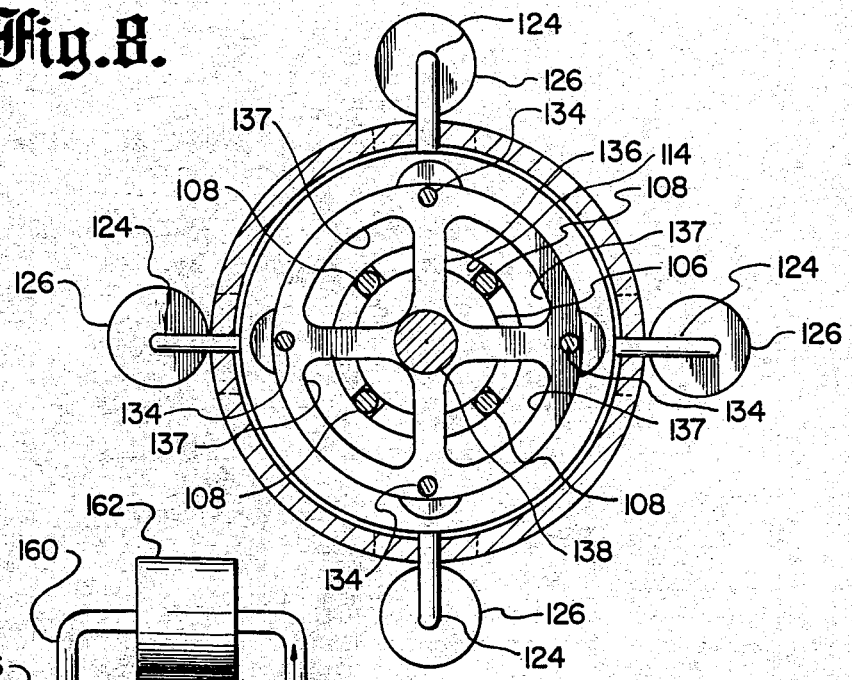
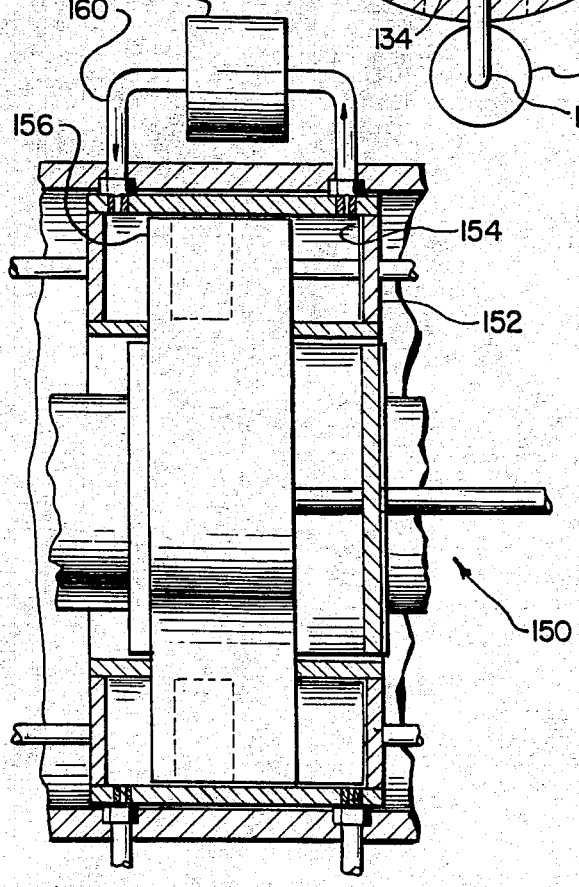
Fig.11.

ELECTRIC ACTUATOR SYSTEM WITH HYDRAULIC COUPLING AS PROTECTION AGAINST MECHANICAL JAMMING

TECHNICAL FIELD

The invention relates to the field of actuator systems for control surfaces of an aircraft and more particularly to an actuator system that can be bypassed upon failure.

BACKGROUND ART

With the prospective emergence of the All Electric Airplane, in which all functions and services are performed electrically, the flight-control surfaces will be operated by some type of electromechanical actuator system (EMAS). Typically, such an EMAS will interface with a quad-redundant fly-by-wire (or fly-by-light) system that will furnish command information to the EMAS, while the flight control system computers being in turn responsible for the management of the EMAS and the airplane's flight characteristics.

In the past, and in most current large airplanes, the control surface actuator function is performed with hydraulic jacks or cylinders. In the event of a hydraulic supply failure (or a failure in the closed loop servo control or a stuck servo-valve etc.) in such systems the hydraulic ram can be bypassed to permit other actuators, connected to the same surface, to continue operation. In the case of the EMAS, however, there is concern that a broken-tooth in a gear-train may cause a mechanical-jam or that a bearing seizure may make it impossible for other (redundant) actuators to drive the control surface. Presently, there is no such simple method to bypass or free-wheel the jammed actuator.

Prior examples of attempts to solve this problem include U.S. Pat. No. 2,441,247 "Mechanical Translating Device" by A. W. Mooney who discloses an electrically powered actuator rotatably mounted to the aircraft structure. Rotation of the actuator is normally prevented by a circular gear mounted to the actuator which is in engagement with a worm gear. Thus, in normal operation, rotation of an output shaft can be accomplished because the worm gear prevents the actuator from rotating. Should the actuator fail, however, the worm gear can be rotated manually or by any other drive means, thus still providing an effective output.

The problem with this actuation system is that if redundancy is required, i.e., two separate actuators controlling the same control surface, there is no means to automatically disengage a failed actuator, since the worm gear cannot be back driven, effectively preventing the actuator from rotating.

Another patent of interest is U.S. Pat. No. 3,950,686 "Series Redundant Drive System" by James C. Randall. Here a plurality of motors are mechanically connected in series so as to provide operational redundancy. The shaft of a given motor is rigidly attached to the housing of the next motor in the series so that rotation of the first shaft will cause the coupled motor and its shaft to rotate. While this system will provide effective operation should one motor fail, the output shafts are held in position by means of the magnetic attraction between the rotor and poles. This does not provide for a positive lock on the position of the control surface connected thereto.

Still another patent of interest is U.S. Pat. No. 4,289,996 "Actuators" by R. R. Barnes et al. Here a pair of motors are coupled to a differential gear assembly which in turn drives a screw assembly attached to the load (a control surface). A lock mechanism is provided on each motor which will lock the motor and prevent its output shaft from rotating should failure of the other motor occur. This allows the other motor to continue to drive the control surface through the differential gear assembly. This system requires that each motor be coupled together by a differential gear assembly. Should the differential gear assembly fail, both motors become ineffective.

Other patents of interest relating to redundance control systems for aircraft control surfaces are U.S. Pat. No. 3,790,108 "Redundant Stabilizer Control" by J. W. Bock; U.S. Pat. No. 2,315,110 "Control Apparatus for Aircraft" by C. Dornier; U.S. Pat. No. 2,491,842 "Actuator System" by B. A. Wells; U.S. Pat. No. 2,549,815 "Servo Unit" by W. L. Huntington; U.S. Pat. No. 3,140,843 "Servo System" by R. H. Pettet; and U.K. Pat. No. 576,797 "Improvements in Electric Motor Drive Units" by C. Heal. None of these fulfills the objectives of the subject invention.

In the field of hydraulic couplings, of interest is U.S. Pat. No. 2,422,545 "Regulating Means for Washing Machine Agitators" by V. Hanson. While this patent relates to washing machines which are far afield from the subject invention, it does disclose a pertinent hydraulic agitator. A hydraulic cylinder is disclosed having a rotatable blade mounted therein which divides the cylinder into two portions. A passageway is provided between the two portions with a valve located therein which can be used to disconnect communications therebetween. While on the surface this hydraulic cylinder is similar to one of Applicant's embodiments, there are significant differences. The primary difference is that an air passage is provided between the blade mounting sleeve and the top and bottom walls (webs), insuring that there is not an airtight fit at either of these points. This is necessary in the Hanson design because the cylinder is sequentially filled and drained of water during the wash cycle and there must be provisions allowing the air to escape. Thus, this device would not be applicable to Applicant's system in that zero leakage between the portions of the cylinder divided by the blade or the exterior of the cylinder is allowable because in normal operation, the blade reacts against the fluid to provide torque transmittal. Furthermore, in the preferred embodiments of Hanson, a fill hole is left open allowing some fluid to be forced out during rotation of the blade. Here again, this would be totally unacceptable on Applicant's actuator assemblies herein disclosed.

Other hydraulic couplings of interest are U.S. Pat. No. 3,182,470 "Sealing Device" by G. N. Smith; U.S. Pat. No. 3,283,537 "Impulse Tool with Bypass Means" by R. P. Gillis; U.S. Pat. No. 1,630,737 "Coupling" by W. B. Flanders; U.S. Pat. No. 1,224,669 "Hydraulic Clutch" by W. L. Rounds; U.S. Pat. No. 3,653,228 "Progressive Clutch" by G. Tiberio; U.S. Pat. No. 2,304,907 "Hydraulic Clutch and Control Mechanism" by C. C. Goodson et al.; U.S. Pat. No. 2,034,021 "Power Transmission Device" by W. S. Brian; U.S. Pat. No. 1,685,839 "Torque Equalizing System" by A. D. Du Bois; U.S. Pat. No. 1,510,368 "Hydraulic Coupling and Change Speed Gear" by S. G. Wingquist; U.S. Pat. No. 3,113,469 "Rotary Viscous Fluid Damper" by A. E. Farr et al.; and U.S. Pat. No. 2,010,366 "Grinding Machine" by B. A. Kearns.

Therefore, it is a primary object of the subject invention to provide an actuation system for primarily controlling the position of a control surface of an aircraft while providing at the same time a means wherein a jammed or disabled actuator can be effectively bypassed to allow other actuators connected to the same control surface to function freely.

It is another object of this invention to provide an actuation system for controlling the position of a control surface of an aircraft wherein a hydraulic coupling is mounted between the actuator and the control surface of the aircraft and which can be used to decouple a jammed or disabled actuator from the control surface. Said hydraulic coupling provides the additional feature of viscous damping.

Another object of the subject invention is to provide an actuation system wherein the hydraulic coupling is efficiently packaged with the actuator by use of an annular hydraulic cylinder with the actuator mounted therein.

DESCRIPTION OF INVENTION

An actuator system for controlling the position of an aerodynamic control surface of an aircraft, such as an aileron, is disclosed. In one embodiment, an actuator having an output shaft is mounted to a frame attached to the aircraft structure. A hydraulic coupling is movably mounted in a hollow sleeve or outer linear bearing system attached to the aircraft structure. The hydraulic coupling comprises a hydraulic cylinder having a piston movably mounted therein dividing the cylinder into two portions. The output shaft of the actuator is coupled to the cylinder. A piston rod is attached to the piston at its input end and the housing or cylinder at the other end is coupled to the control surface.

A tube is provided connecting the two portions of the hydraulic cylinder together. Installed in the tube is a valve having a first position sealing the two portions from each other and a second position providing a passageway therebetween.

Thus, if the actuator is working and the valve is closed, an essentially solid connection is achieved between the actuator and the control surface, thus allowing the actuator to move the control surface upon command. Should the actuator fail, the valve is opened, allowing fluid to flow between the two portions. Thus a redundant actuator can continue to control the position of the control surface while the disabled actuator is effectively decoupled from the control surface, i.e., the piston will just move back and forth within the cylinder as the control surface moves. It should be noted that the piston rod can be coupled to the actuator and the cylinder can be coupled to the control surface (reversing the position of the hydraulic cylinder).

In a second embodiment a rotary actuator is mounted to the aircraft structure having an output shaft coupled to the input shaft of a hydraulic coupling. In this embodiment the hydraulic coupling comprises a hydraulic cylinder having a rotatable vane coupled to the input shaft mounted therein dividing the hydraulic cylinder into two portions. The two portions are coupled together by a tubular member which has a valve mounted therein. The valve has a first position blocking fluid flow between the portions and a second position allowing the fluid to flow freely therebetween. The hydraulic cylinder is, in turn, coupled to the aircraft control surface. Thus, in normal operation, rotation of the output shaft of the actuator will cause the vane to push against the trapped hydraulic fluid, causing the housing to rotate, which in turn causes the control surface to move. Should a failure of the actuator occur, the valve is opened allowing fluid flow between the portions.

In a third embodiment a generally clindrical frame is provided which is attached to the aircraft structure. A linear actuator having a threaded output shaft is mounted to the frame. A hydraulic coupling is provided which comprises a hydraulic cylinder movably mounted to the frame and having a centrally located annular opening in which the electric actuator is at least partially mounted therein. The hydraulic coupling contains at least one hydraulic cylinder having a piston movably mounted therein. The piston divides the at least one hydraulic cylinder into two portions. A piston rod is coupled to the piston at one end and at the opposite end to a flange member attached to a traveling nut which, in turn, is coupled to the threaded output shaft of the rotary actuator. The hydraulic cylinder also incorporates an output shaft which is coupled to a second flange supporting an output shaft which, in turn, is coupled to the control surface of the aircraft. In a modified version of this embodiment, the hydraulic cylinder has an annular chamber in which an annular piston is mounted therein.

In both embodiments the piston divides the cylinder into two portions. The two portions are coupled together by a tubular member having a valve mounted therein. The valve in a first position separates the two portions from each other and a second position allows free fluid flow therebetween. Thus, in normal operation, as the threaded shaft rotates, the nut translates thereon. Since fluid prevents relative motion between the piston and the hydraulic cylinder, there is effectively a direct hydraulic coupling between the rotary actuator and the control surface.

However, should the rotary actuator fail, the valve can be opened, allowing free fluid flow between the two portions of the hydraulic cylinder. This effectively decouples the control surface from the rotary actuator, because any input from the control surface, due to a redundant actuator being activated, will cause the hydraulic cylinder to move about the piston. Here again, the hydraulic coupling can be reversed, i.e., the piston rod can be coupled to the output shaft and the hydraulic cylinder can be coupled to the traveling nut mounted on the output shaft of the rotary actuator.

The novel features which are believed to be characteristic of the invention, both as to its organization and its method of operation, together with further objects and advantages thereof, will be better understood from the following description in connection with the accompanying drawings in which presently preferred embodiments of the invention are illustrated by way of example. It is to be expressly understood, however, that the drawings are for purposes of illustration and description only, and are not intended as a definition of the limits of the invention.

BRIEF DESCRIPTION OF THE DRAWINGS

Illustrated in FIG. 1 is a side elevation view of an actuator assembly partially broken away to disclose the interior of the hydraulic coupling connecting the actuator to the aircraft control surface;

Illustrated in FIG. 2 is a plan view (a view looking downward) of a dual actuator assembly showing a rotary actuator version of the subject invention;

Figure 2:
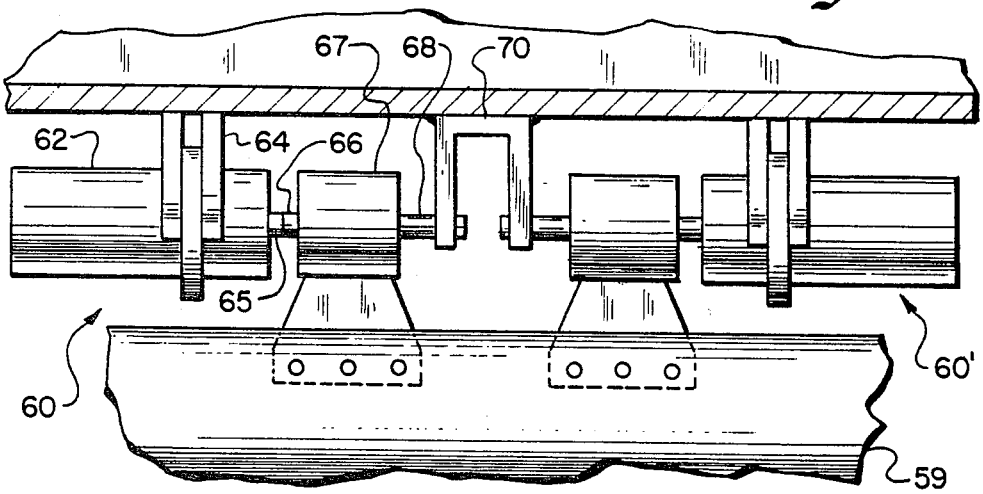
Figure 3:
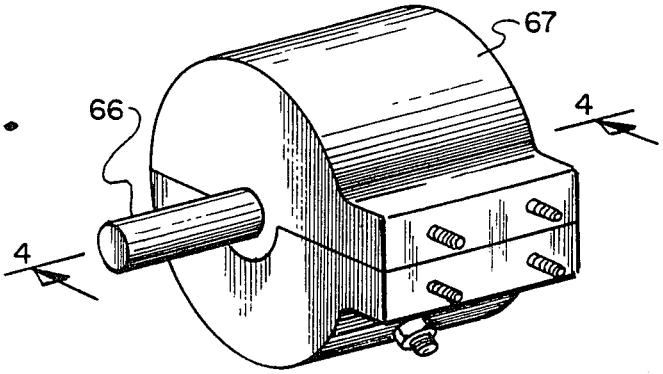
Figure 4:
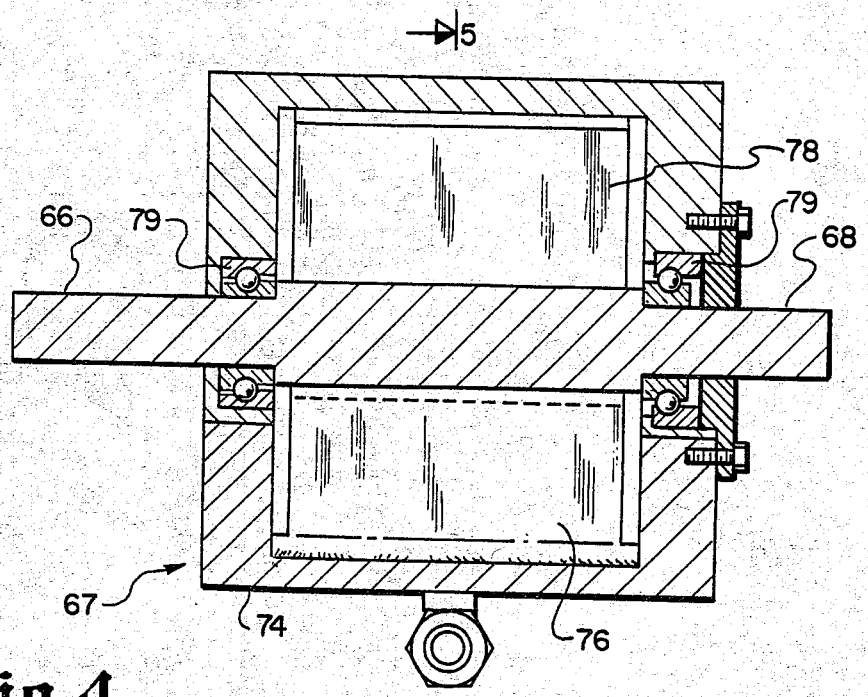
Figure 5:
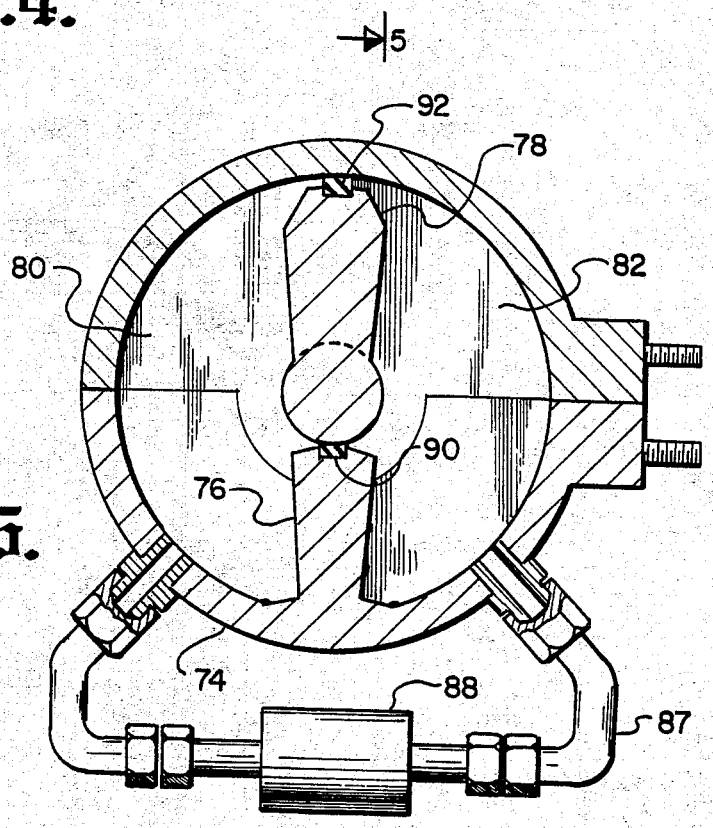
Figure 6:
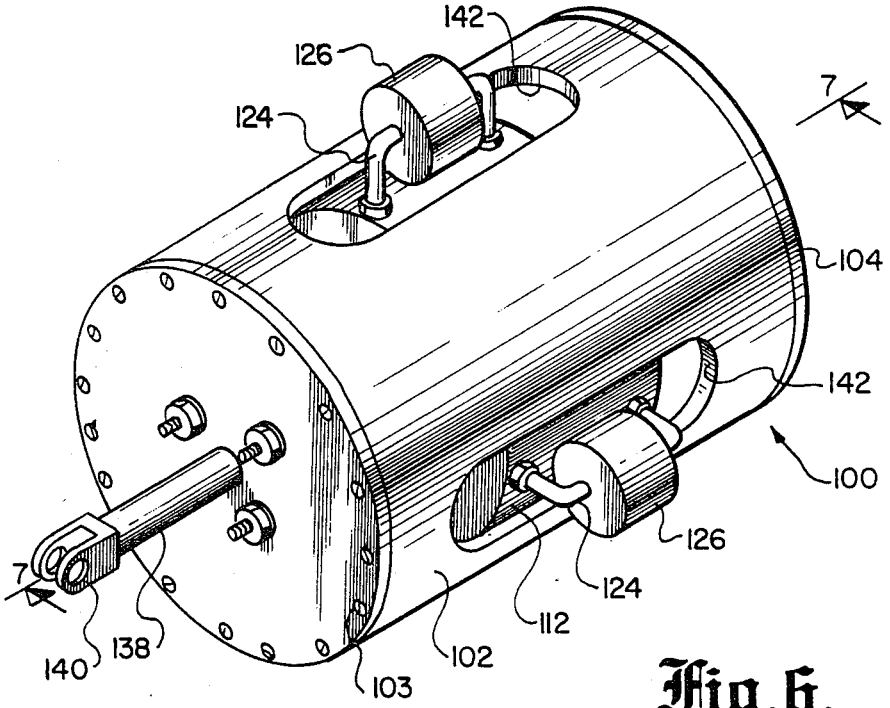
Figure 7:
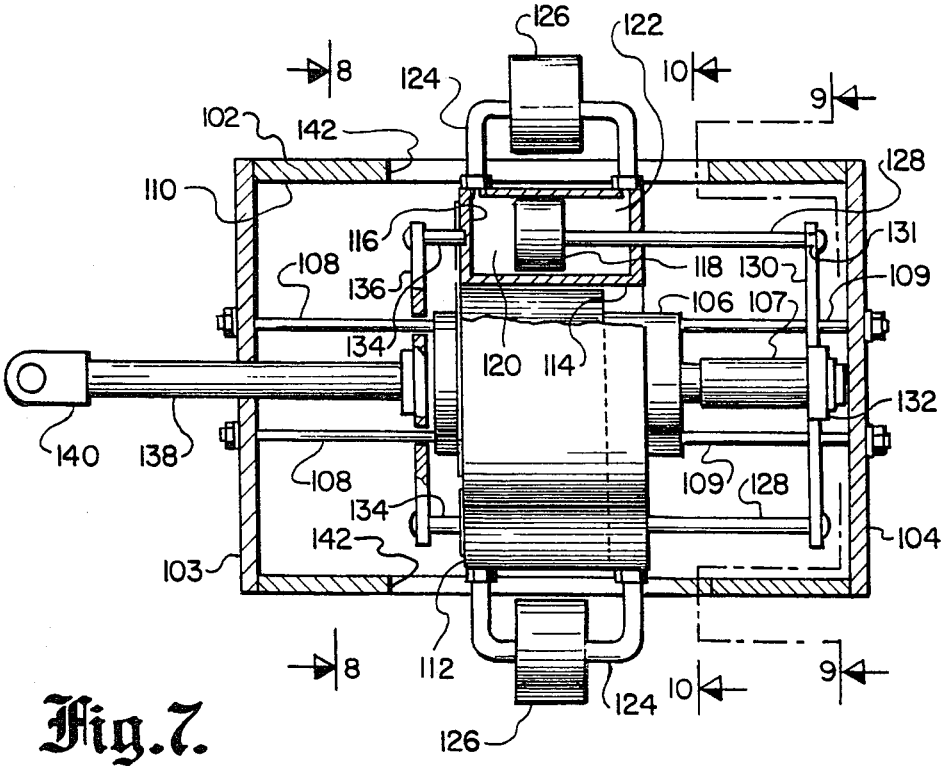
Figure 9:
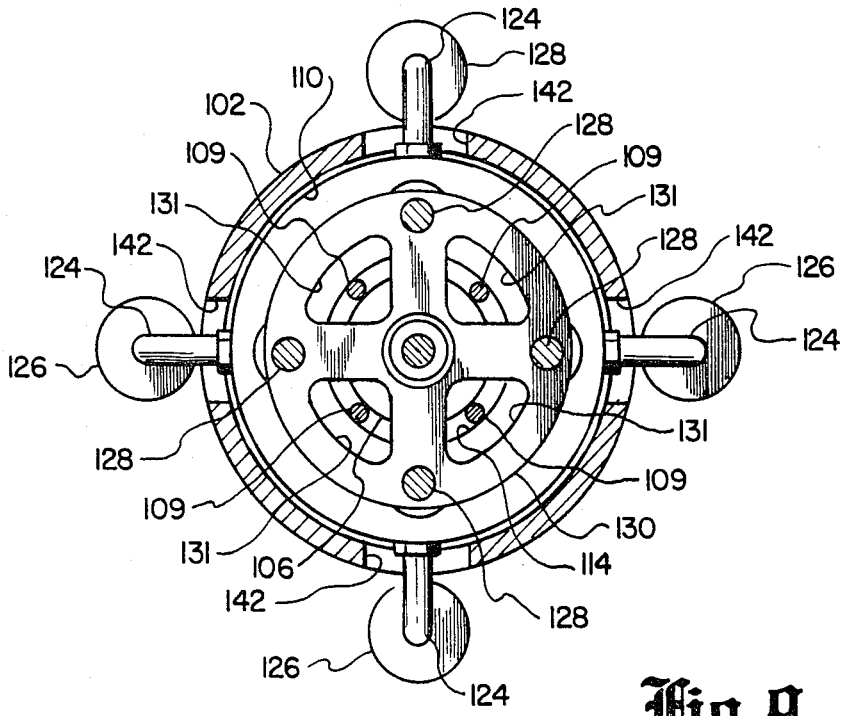
Figure 10:
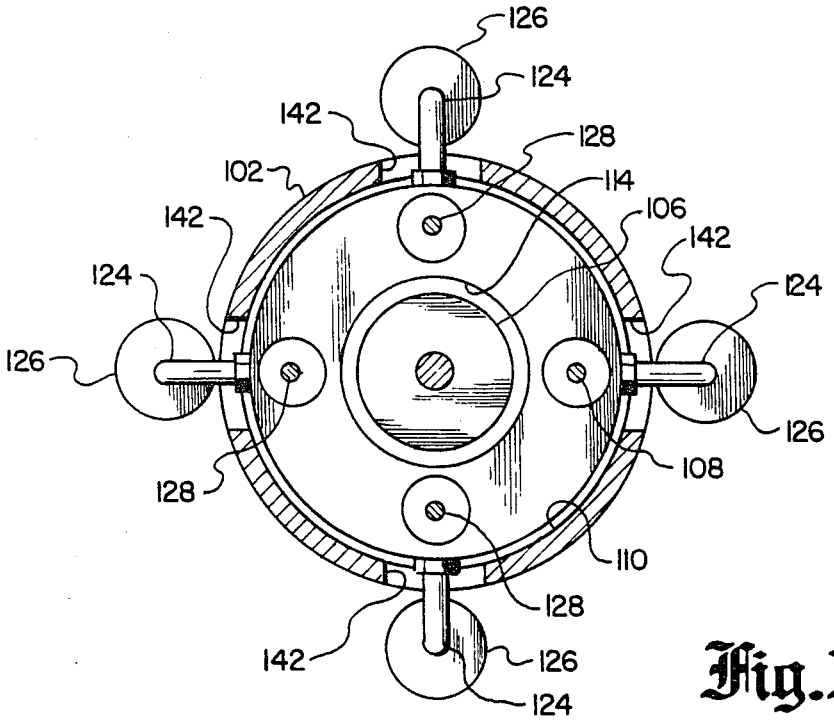

Illustrated in FIG. 3 is a perspective view of a hydraulic coupling used in the actuator assembly disclosed in FIG. 2;

Illustrated in FIG. 4 is a cross-sectional view of the hydraulic coupling shown in FIG. 3 along the line 4—4;

Illustrated in FIG. 5 is a cross-sectional view of the hydraulic coupling shown in FIG. 4 along the line 5—5;

Illustrated in FIG. 6 is a perspective view of another embodiment of the subject invention, wherein the actuator is mounted within an annular shaped hydraulic cylinder;

Illustrated in FIG. 7 is a cross-sectional view of the actuator assembly illustrated in FIG. 6 along the line 7—7;

Illustrated in FIG. 8 is a cross-sectional view of the actuator assembly illustrated in FIG. 7 along the line 8—8;

Illustrated in FIG. 9 is a cross-sectional view of the actuator assembly shown in FIG. 7 along the line 9—9;

Illustrated in FIG. 10 is a cross-sectional view of the actuator assembly shown in FIG. 7 along the line 10—10; and Illustrated in FIG. 11 is a partial view of a modified version of the actuator assembly shown in FIGS. 6 and 7 wherein the hydraulic coupling comprises an annular hydraulic cylinder incorporating an annular shaped hydraulic piston.

BEST MODE OF CARRYING OUT THE INVENTION

Figure 1:
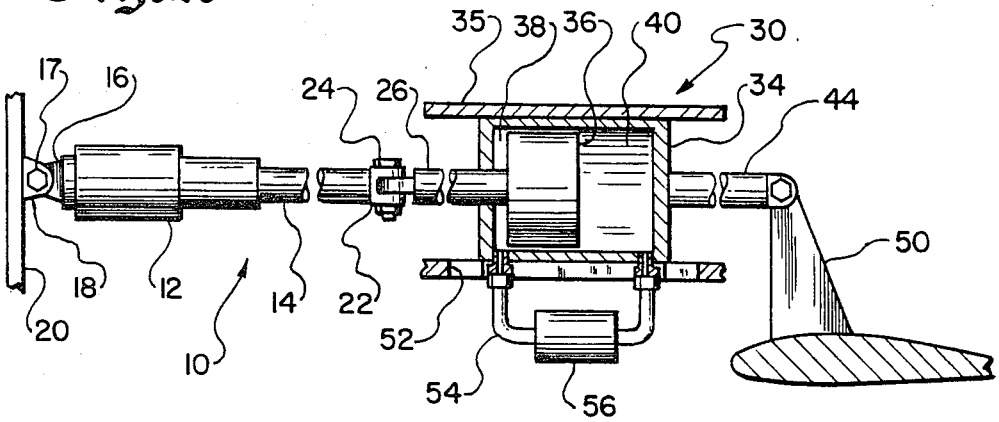

Illustrated in FIG. 1 is a side elevation view of an actuator assembly partially broken away to show the interior of a hydraulic coupling device portion thereof. The actuator assembly, generally designated by numeral 10, comprises an actuator 12 which is typically a motor driven linear output actuator having an output shaft 14. The opposite end of the actuator 12 terminates in a lug 16 which is fastened to a clevis 18 attached to aircraft structure 20 (typically a spar beam). The output shaft 14 terminates in a clevis 22 which is fastened to a lug 24 on the input shaft 26 of a hydraulic coupling 30. The hydraulic coupling 30 comprises a hydraulic cylinder 34 filled with substantially incompressible fluid, such as hydraulic fluid, and is slidably mounted in a sleeve 35 attached to aircraft structure (not shown). The sleeve 35 is preferably a linear bearing. The input shaft 26 is coupled to a piston 36 which is movably mounted within the cylinder 34 and which effectively divides the cylinder into first and second portions 38 and 40. An output shaft 44 is coupled at one end to the cylinder 34 and at its opposite end to an aircraft control surface assembly 50 such as an aileron.

Portions 38 and 40 of the hydraulic cylinder 34 are coupled together by a tube 54. Mounted to the tube is a valve 56, typically a normally closed solenoid operated valve. When the valve 56 is in the closed position, the hydraulic fluid is trapped on either side of the piston 36 and, thus, the piston 36 cannot translate relative to the cylinder 34. Thus, the actuator 12 is effectively coupled directly to the aircraft control surface 50 because the hydraulic fluid is substantially incompressible. Typically, two or more such actuator assemblies 10 are provided for each control surface assembly.

If the actuator 12 should fail, a signal is sent to the valve 56 causing it to open, allowing hydraulic fluid to pass freely from portion 38 to portion 40 and vice versa. Thus, the actuator 12 is effectively decoupled and the other actuator assembly (not shown) can still control the aircraft control surface assembly 50. The only motion that occurs is that of cylinder 34 moving back and forth about the stationary piston 36. Note, that in order to allow translation of the cylinder 34, the sleeve incorporates an aperture 52 to accommodate the motion of tube 54 and valve 56. Finally, it can be appreciated that the hydraulic cylinder 34 could be reversed and still function, i.e., the piston 36 could be coupled to the control surface and the cylinder 34 could be coupled to the output shaft 14 of the actuator 12.

Illustrated in FIG. 2 is a plan view (looking downward) of a portion of a control surface for an aircraft that is coupled to dual actuator assemblies (a second embodiment). Illustrated in FIG. 3 is a perspective view of a second embodiment of the hydraulic coupling. Illustrated in FIG. 4 is a cross-sectional view of the hydraulic coupling shown in FIG. 3 along the line 4—4. Shown in FIG. 5 is a cross-sectional view of the hydraulic coupling shown in FIG. 4 along the line 5—5.

Referring now to FIGS. 2-5, it can be seen that the control surface 59 is coupled to identical dual actuator assemblies, generally designated by numerals 60 and 60'. Since the actuator assemblies 60 and 60' are identical, the subsequent description will be limited to assembly 60. The actuator assembly 60 comprises an actuator, typically a rotary electric actuator 62 mounted to the aircraft structure 64. The output shaft 65 of the actuator 62 is directly coupled to the input shaft 66 of the hydraulic coupling 67. The input shaft 66 is supported at its opposite end 68 by a bearing assembly (not shown) mounted in additional aircraft structure 70. The hydraulic coupling 67 essentially comprises a hollow cylinder 74 incorporating a stationary vane member 76 and a rotating vane member 78 coupled to the shaft 66. The shaft 66 is also rotatably supported in the cylinder 74 by means of bearings 79. Thus, the cylinder 74 is effectively divided into first and second portions 80 and 82 which are both filled with a substantially incompressible liquid such as hydraulic oil.

The portions 80 and 82 of the cylinder 74 are coupled together by a tube 87. The tube 87, in turn, incorporates a normally closed valve 88, preferably solenoid operated. Thus, with the valve 88 in its normally closed position, portions 80 and 82 are sealed off from each other. Note that seals 90 and 92 prevent internal leakage between portions 80 and 82. In normal operation, with the valve 88 closed, a positive connection is made from the actuator output shaft 65 to the control surface 59. Should one of the motors fail, say motor 62 of actuator assembly 60, valve 88 is opened, allowing fluid to freely flow from portion 80 to portion 82 and vice versa, effectively decoupling the failed motor 60 from the control surface, i.e., if the output shaft 65 cannot rotate due to a motor failure, the cylinder 74 is free to rotate freely around the vane 90. In this situation the actuator assembly 60' continues to power the control surface and "back drives" the cylinder 74 of the hydraulic coupling 67 of the failed actuator assembly 60.

Illustrated in FIG. 6 is a perspective view of a third embodiment of the subject invention wherein the actuator and hydraulic coupling are integrated into one assembly. Illustrated in FIG. 7 is a cross-sectional view of the actuator assembly shown in FIG. 7 along the line 7—7. Illustrated in FIG. 8 is a cross-sectional view of the actuator assembly shown in FIG. 7 along the line 8—8. Illustrated in FIG. 9 is a cross-sectional view of the actuator assembly shown in FIG. 7 along the line 9—9. Illustrated in FIG. 10 is a cross-sectional view of the actuator assembly shown in FIG. 7 along the line 10—10.

Referring to FIGS. 6–10, it can be seen that the actuator assembly, generally designated by numeral 100, comprises an outer cylindrical housing 102 having end caps 103 and 104 joined thereto. Mounted within the cylinder 102 is a rotary actuator 106, typically electrically powered, having a threaded screw jack type output shaft 107. The actuator 106 is maintained substantially in the center of the cylinder by a plurality of support rods 108 and 109 rigidly attached to the actuator 106 and bolted to the end caps 103 and 104, respectively.

Slidably mounted on the interior wall 110 of the cylinder 102 is an annular-shaped hydraulic cylinder assembly 112 having an aperture 114 through which the actuator 106 extends. As illustrated, hydraulic cylinder assembly 112 incorporates four hydraulic cylinders 116 (only one is shown in cross section in FIG. 7). Mounted within the cylinders 116 are pistons 118 effectively dividing the cylinder into first and second portions 120 and 122. Tubes 124 connect the two portions together. Mounted to the tubes 124 are valves 126, preferably normally closed solenoid operated valves. Thus, portion 120 is normally sealed off from portion 122 of the cylinders 116. The pistons 118 are coupled to piston rods 128 which, in turn, are all coupled to a plate 130. The plate 130 incorporates aperture 131 through which rods 108 pass. The plate 130 at its center incorporates a recirculating ball traveling nut 132 coupled to the output shaft 107 of the actuator 106.

Coupled to the hydraulic cylinder assembly 112 are four shafts 134 which are fastened to a plate 136. The plate 136 incorporates apertures 137 through which rods 108 pass. Attached to the center of the plate is an output shaft 138 which terminates in a clevis 140. The clevis 140 in turn is, typically, coupled by control rods (not shown) to a control surface (not shown).

In normal operation the electric actuator 106 drives the output shaft 107. With the traveling nut 132 in engagement with the output shaft 107, the hydraulic cylinder assembly 112 will translate forward or backward, depending on the direction of rotation of the shaft 107. Note, that with the valves 126 closed, hydraualic fluid is trapped on either side of the pistons 118, and since the fluid is substantially incompressible, an effective solid connection is made between the output shaft 138 and the output shaft 107 of the actuator 106.

In order to provide for the translation of the hydraulic cylinder assembly, apertures 142 are provided in the cylindrical housing to accommodate movement of the tubes 124 and valves 126.

If, however, actuator 106 jams or otherwise fails, electrical signals are directed to the valves 126, connecting portions 120 and 122 of the hydraulic cylinders 116. When this occurs, the hydraulic cylinders 116 are essentially hydraulically decoupled from the output shaft 107 and therefore are free to move fore and aft. Thus, when two or more of these actuator assemblies 112 are coupled to a control surface and one fails, the other can still be used to control the position of the control surface.

Illustrated in FIG. 11 is a partial view of an actuator assembly, generally designated by numeral 150, disclosing a modified version of the hydraulic cylinder assembly shown in FIGS. 6–10. In this embodiment the hydraulic cylinder assembly, designated by numeral 152, comprises an annular cylinder 154 containing an annular piston 156. Only one tubular connection designated by numeral 160 is required with the normally closed solenoid operated valve 162 mounted therein. This configuration has the advantage of requiring only one valve.

It should be noted that in the embodiments illustrated in FIGS. 6–11 the hydraulic cylinder assemblies could be reversed with the piston(s) coupled to the output shaft and the cylinder(s) coupled to the actuator. Regardless of the arrangement selected the main advantage of these embodiments (FIGS. 6–11) is that due to the nested arrangement between the hydraulic cylinder assembly and the actuator considerable space is saved, i.e., reduced overall length.

Finally, while the actuator assembly has been described with reference to particular embodiments, it should be understood that such embodiments are merely illustrative as there are numerous variations and modifications which may be made by those skilled in the art. Thus, the invention is to be construed as being limited only by the spirit and scope of the appended claims.

I claim:

1. An actuator assembly for an aircraft having a fixed structure to which a movable control surface is mounted comprising:

a supporting frame attached to said structure;

an actuator mounted to said frame, said actuator having an output shaft;

a hydraulic coupling comprising:

a hydraulic cylinder movably mounted to said structure, said hydraulic cylinder filled with a substantially incompressible fluid;

a pair of connecting members coupled to said hydraulic cylinder, one of said pair of connecting members coupled to said output shaft of said actuator and the other of said pair of connecting members coupled to said control surface;

a sealing member movably mounted in said cylinder, dividing said cylinder into first and second portions, said sealing member cooperating with said fluid to prevent relative movement between said pair of connecting members;

passage means connecting said first and second portions of said cylinder; and valve means mounted in said passage means, said valve means having a first position sealing off said first and second portions from each other and a second position coupling said first and second portions together;

such that when said valve is in the first position, relative movement between the pair of connecting members is prevented and a substantially solid coupling is made between said actuator and said control surface and when said valve is in the second position the sealing member is free to move relative to said cylinder and, thus, said pair of connecting members are movable with respect to each other, thus allowing the movement of said control surface regardless of actuator output shaft position.

2. The actuator assembly as set forth in claim 1 wherein said sealing member is a piston slidably mounted within said cylinder.

3. The actuator assembly as set forth in claim 2 wherein one of said pair of connecting members is an output shaft coupled to said piston and to said control surface and said other one of said pair of connecting members is an input shaft coupled to said cylinder and said output shaft of said actuator.

4. The actuator assembly as set forth in claim 2 wherein one of said pair of connecting members is coupled to said piston and said output shaft of said actuator and said other one of said pair of connecting members is an output shaft coupled to said cylinder and said control surface.

5. The actuator assembly as set forth in claim 3 or 4 wherein a sleeve is mounted to said aircraft structure, and said hydraulic cylinder is at least partially slidably mounted within said sleeve.

6. The actuator assembly as set forth in claim 5 wherein said valve means is a normally closed solenoid operated valve.

7. The actuator assembly as set forth in claim 1 wherein said actuator is a rotary actuator.

8. The actuator assembly as set forth in claim 7 wherein said sealing member is a vane rotatably mounted within said cylinder, and one of said coupling members is an input shaft coupled to said vane and to said output shaft of said rotary actuator and said second of one of said coupling members is a flange attached to said hydraulic cylinder and to said control surface.

9. The actuator assembly as set forth in claim 8 wherein said valve means is a normally closed solenoid actuated valve.

10. An actuator assembly for an aircraft having a fixed structure to which a movable control surface is mounted thereto comprising:

a supporting frame attached to said structure;

a rotary actuator mounted to said frame, said actuator having a threaded output shaft;

a hydraulic coupling comprising:

at least one hydraulic cylinder movably mounted to said frame, said at least one hydraulic cylinder filled with a substantially incompressible fluid;

a piston movably mounted within said at least one hydraulic cylinder and dividing said at least one hydraulic cylinder into first and second portions;

a piston rod coupled to said piston and having an end protruding out of said at least one hydraulic cylinder;

passage means connecting said first and second portions of said at least one hydraulic cylinder; and valve means mounted in said passage means, said valve means having a first position sealing off said first portion to a second portion connecting said first and second portions;

a translating nut assembly movably mounted to said threaded output shaft and to said piston rod, said nut adapted to translate along the length of said threaded output shaft upon rotation of said output shaft;

and a member connected to said at least one hydraulic cylinder adapted to couple to said movable control surface.

11. The actuator assembly of claim 10 including said frame being of a hollow cylindrical shape.

12. The actuator assembly as set forth in claim 11 including said hydraulic coupling having an annular opening and said rotary actuator at least partially mounted within said annular opening of said hydraulic coupling.

13. The actuator assembly as set forth in claim 12 wherein movement of said at least one hydraulic coupling is guided by said cylindrical frame.

14. The actuator assembly as set forth in claim 13 wherein said valve is a normally closed solenoid actuated valve.

* * * * *